US005094087A

United States Patent [19]

Gramkow

[11] Patent Number: 5,094,087

[45] Date of Patent: Mar. 10, 1992

[54] APPARATUS FOR RECOVERY OF LIQUIDS SUCH AS REFRIGERANTS

[75] Inventor: Asger Gramkow, Augustenborg, Denmark

[73] Assignee: A'Gramkow A/S, Sonderborg, Denmark

[21] Appl. No.: 548,211

[22] Filed: Jul. 5, 1990

[30] Foreign Application Priority Data

Jul. 4, 1989 [DK] Denmark ..... 3300/89
Nov. 29, 1989 [DK] Denmark ..... 6005/89

[51] Int. Cl.[5] ..... F25B 45/00

[52] U.S. Cl. ..... 62/292; 62/149; 62/475

[58] Field of Search ..... 62/85, 475, 292, 474, 62/149, 529

[56] References Cited

U.S. PATENT DOCUMENTS 3,205,679 9/1965 Geist et al. ..... 62/474
4,805,416 2/1989 Manz et al. ..... 62/292
4,809,515 3/1989 Houwink ..... 62/149
5,018,361 5/1991 Kroll et al. ..... 62/85

*Primary Examiner*—Albert J. Makay
*Assistant Examiner*—John Sollecito
*Attorney, Agent, or Firm*—Antonelli, Terry, Stout & Kraus

[57] ABSTRACT

An apparatus for reclaiming and recovering a volatile liquids such as a refrigerant contained in a closed working circuit. An inlet separator container is connected with a suction side of a compressor for an intake of a liquid and a gaseous phase, and a condenser is connected with a discharge side of the compressor, the condenser is additionally connected with a receiver for the condensed liquid, and a purifying filter is arranged in a flow connection between the separator container and the receiver. The filter includes a moisture adsorbing filter, and the filter is arranged in a flow connection between a discharge side of the compressor and the condenser, with an oil mist filter being mounted upstream of the moisture adsorbing filter.

5 Claims, 2 Drawing Sheets

APPARATUS FOR RECOVERY OF LIQUIDS SUCH AS REFRIGERANTS

FIELD OF THE INVENTION

The present invention relates to a method and a system for recovery of refrigerants or other volatile liquids from closed working circuits, e.g. from refrigeration units to be scrapped or repaired, or for purifying the amount of refrigerant in a given system and then returning it to the same system. Care should be taken to prevent the gases from escaping to the atmosphere, where they are highly undesired. Normally, used refrigerants are polluted, e.g. by water and oil, and for enabling them to be reused it is required to subject them to an effective purification.

BACKGROUND OF THE INVENTION

These problems have already been described and discussed in detail in many patent specifications, of which a few examples are the U.S. Pat. Nos. 4,285,206 4,441,330 and 4,476,688.

Common to the majority of the known proposals for recovery techniques is that the refrigerants are handled and processed in their liquid phase. Admittedly it is relatively easy to effect a coarse cleaning of a refrigerant in the liquid phase thereof, by filtration and separation, but it is difficult and very expensive for such a technique to satisfy the increasing requirements as to the high degree of purification of the collected amounts of refrigerant.

In connection with the present invention it has been found that it is much better to concentrate on the handling and processing of the refrigerants in their gaseous phase, whereby a very high degree of purification is achievable in a more economical manner. The principle of concentrating or working on the gaseous refrigerant, however, is known already from the U.S. Pat. No. 3,699,781, and it is the purpose of the present invention to provide important improvements in the technique disclosed therein and as known otherwise.

The refrigerant in the system to be emptied is withdrawn therefrom by connecting a suction conduit from the recovering unit to a connector stub of the said system, whereby the polluted refrigerant is sucked into or through a container constituting a coarse separator for liquid and gaseous components, respectively. Already hereby a high percentage of impurities, mainly oil, will be separated for later discharge from the separator, but even a small amount of refrigerant in its liquid phase may be transferred to the separator container, more or less in admixture with the sludge of impurities. It should be prevented that such a remnant of refrigerant can leave the container by the emptying thereof, as the emptied product will normally be led into connection with the atmosphere and the atmospheric pressure, whereby the contents of refrigerant would surely escape to the atmopshere.

Particularly when it is desired to process the refrigerant in its gaseous phase it is also natural to seek to counteract the formation or collection of liquid refrigerant in the separator container by adding heat to the surroundings or otherwise arrange for a heating which will promote a boiling of the liquid refrigerant to thereby convert all of it into its gaseous phase. According to the said U.S. Pat. No. 3,699,781 this is accomplished by arranging for a heating of a portion of the conduit between the suction stub and the separator container, whereby remnants of liquid refrigerant already by its inflow to the separator will be heated for accelerated boiling such that all of it will be converted into the gaseous phase and thus not be present in the product to be let out from the bottom of the separator container.

This measure, however, has a serious drawback in that the said heating will be associated with a raised vapor pressure that will directly counteract the attainment of the desired high degree of emptying of the refrigeration system, as the increased vapor pressure will form a barrier to an almost complete emptying of the system.

SUMMARY OF THE INVENTION

According to the present invention it has been found that there is in fact no need to apply heat in order to ensure a full vaporisation of the refrigerant. Almost to the contrary, the liquid refrigerant fraction collected in the separator container will be perfectly willing to boil up, and by that boiling heat will be taken from the close surroundings, i.e. the temperature will decrease such that the vapor pressure will also decrease and thus enable a more complete evacuation of the refrigerant from the refrigerator system. A slight heating of the separator container could be useful when the rate of inflow is high, but the inflow as such should not be heated already before it enters the separation container.

From the top stub of the separation container the gas flow is conveyed to a filter system, all by the action of a gas compressor, the suction side of which is connected to the said top stub. In the system according to U.S. Pat. No. 3,699,781 the compressor is thus connnected through the required main filter for adsorbing water from the gas, i.e. the gas is sucked to the compressor first through the separation container and next through the filter. According to the invention it has been found that an improved arrangement is to locate, circuitwise, the compressor as close as possible to the separation container and then arrange the filter on the discharge side of the compressor. This again contributes to a high efficiency of the emptying by suction of the system to be emptied, because the inevitable pressure drop in the filter will be moved to the discharge side of the compressor. Thus, the full suction pressure will be available for the emptying, and on the discharge side of the compressor there will be plenty of pressure for driving the gas through the filter system.

In connection with the use of gas filtering in stead of liquid filtering and with the use of adsorption filter means to be dried out between consecutive operative periods there is a problem, which is not even considered in the U.S. Pat. No. 3,699,781, viz. that the drying of the filter by means of a flow of a dry gas will be associated with a driving out of the remnant of the contaminating gas as still housed in the filter when the system is switched over from operation mode to drying mode. In the said U.S. Patent the filter is dried by way of a warm counterflow of dry nitrogen which is let out into the atmosphere after passing the filter, and thus the entire amount of gaseous refrigerant trapped in the filter will escape to the atmosphere. On this background it is an important aspect of the present invention that care is taken to remove the said remnant in a controlled manner so as to avoid escape thereof to the atmosphere. According to the invention this is obtained by connecting the filter, once its operational inlet has been closed, to a source of suction in a closed system such that the said remnants or by far the major amount thereof will be removed from the filter and guided to a closed receiver, preferably combined with a condenser for converting the gas into liquid, e.g. for later recycling through the purification system.

According to the invention, however, there is no need to use a separate suction source for this purpose, as the closed filter space can simply be connected with the low pressure side of the said compressor of the system; this can be done in different manners according to the detailed design of the system, as discussed in more detail below.

By the associated lowering of the pressure in the filter space it will be ensured not only that almost all remnants of gas will be removed from the space, but also that conditions are created for any possible liquid remnants to boil up and thus leave the filter in a gaseous state. By way of example it can be sufficient to expose the filter to the low pressure for a few seconds, which can be sufficient to ensure the controlled removal of the gas remnants, whereafter the filter can be dried by means of a dry air flow exhausted into the atmosphere without any noticeable amount of refrigerant gas being let out.

While in the said U.S. Pat. No. 3,699,781 the adsorbing filter is dried by means of a flow of dry nitrogen it is perceived by the present invention that it is operationally much cheaper to dry the filter by means of dry atmospheric air, where it is not sufficient to effect the drying just by applying a vacuum on the filter, and in a preferred embodiment of the invention the system comprises a subsystem for delivering dry air for the purpose, fed preferably by ordinary compressed shop air.

The invention also provides for a system, which can operate continually, based on the use of a dual filter system operable in an alternating manner such that one filter can be operative while the other is being dried, and vice versa.

BRIEF DESCRIPTION OF THE DRAWINGS

In the following the invention is described in more detail with reference to the drawings, in which.

DETAILED DESCRIPTION

Figure 1:
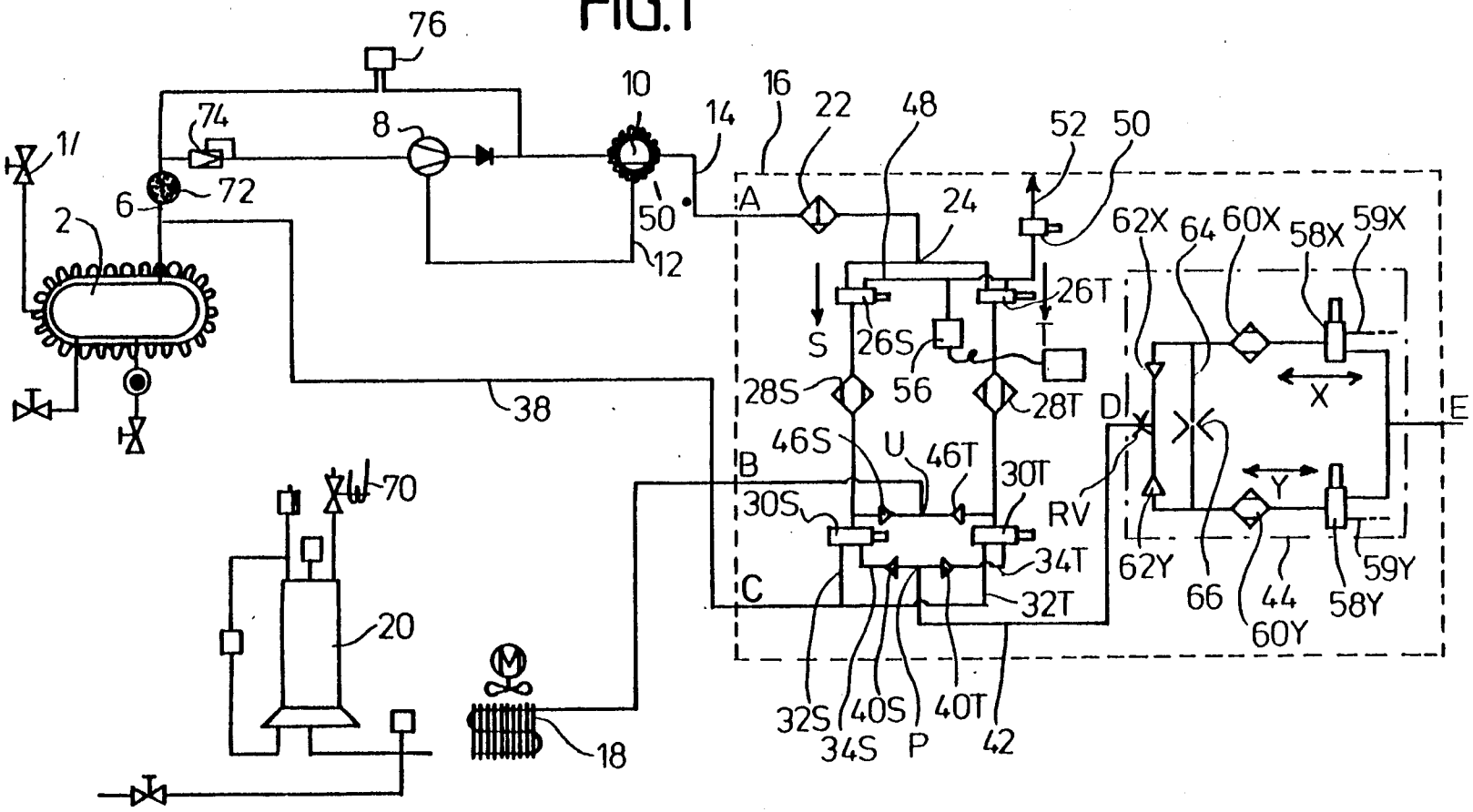
FIG. 1 is a diagram of a preferred embodiment of a recovery system according to the invention.

In FIG. 1 the numeral 2 designates a receiver container for a liquid and/or gaseous refrigerant supplied through an inlet valve 4, e.g. from a scrapped refrigeration unit. The container may be provided with the container is heat insulated and can be provided with a heater body or a heater jacket, by means of which any liquid refrigerant may be brought to boil for conversion into a gaseous state, though preferably only towards the end of the inlet period. Via an outlet pipe 6 the gas can be drawn to the suction side of a compressor 8, at the discharge side of which the compressed gas is passed through an oil separator 10, from which regained oil is led back to the compressor through a conduit 12. The oil separator 10 may be heated by means not shown, for preventing any condensation of the refrigerant vapor. The vapor is pressed further through a conduit 14 to an inlet A of an apparatus block 16 as specified in more detail below, from which block the gas in a purified condition is let out at B for delivery to a condenser 18, in which the purified gas is condensed and then brought further to a receiver tank 20, from which the recovered refrigerant may be collected for renewed use.

Inside the block system 16 the pressurized gas is passed through an associated oil mist filter 22, in which the last significant oil fraction will be precipitated from the gas, and from there the gas is pressed further to a junction 24, from which it can be passed further into two parallel stretches S and T of uniform design. At the top of each of these stretches is provided a solenoid switch valve 26S, 26T after which there is mounted a drying filter 28S, 28T and at the lower end a solenoid switch valve 30S, 30T having lower conduit connections 32S, 32T and 34S, 34T; 'upper' and 'lower' and similar expressions here refer to the graphic illustration and not necessarily to the mounting of the various parts in practice. The conduits 32S, 32T in stretches S and T, respectively, are outlet conduits connected directly to a common conduit 36 leaving the block 16 at C and continuing in a conduit 38 back to the outlet or suction pipe 6. Correspondingly the conduits 34S, 34T of the switch valves 30S, 30T are, through respective check valves 40S, 40T connected to a common point P, from which a conduit 42 extends to a connector area D of a subunit 44 of the block 16.

The upper connector conduits of the solenoid valves 30S, 30T are connected, through respective check valves 46S, 46T, to a common point U, which is in pipe connection with the connector port B.

At their top sides the upper solenoid valves 26S, 26T each has two connections, viz. an inlet connection from the common point 24 and an outlet conduit 48 to a solenoid valve 50, through which the conduit 48 can be connected to the atmosphere through an exhaust conduit 52.

The solenoid valves are controlled from a control unit 54 also connected with a pressostat 56 sensing the pressure in the outlet conduit 48.

The sub unit 44 has an inlet port E for receiving ordinary workshop compressed air, which in the unit 44 can pass along two parallel stretches X and Y each including a solenoid switch valve 58X, 58Y a moisture adsorbing filter 60X, 60Y and a check valve 62X, 62Y. Between the filters 60 and the common discharge point D is provided a short circuit connection 64 passing through a limiter valve 66.

During an initial phase of operation the solenoid valve 26S is kept open, while the valve 26T is kept closed, whereby the gas flow from the junction 24 will be passed through the stretch S and thus through the moisture filter 28S and the check valve 46S out to the outlet conduit from port B and further to condensation in the condenser 18 and collection in the tank 20. In the filter 28S a practically total demoisturing of the gas flow will take place, but of course the filter itself will thus become moistured. In several different manners it is possible to detect that this moisturing is not driven beyond the point where the filter is still capable of effecting the desired thorough demoisturing of the gas, and in ordinary operation it may be sufficient to rely on a suitable maximum operation time of the filter, based on experience, whereby still a broad safety margin can be ensured.

When the degree of moisturing of the filter 28S has reached the relevant maximum the solenoid valve 26S is closed and the solenoid valve 29T is opend. Thereafter, in a fully corresponding manner, it will be the filter 28T, which is operative during a following period of operation. During this following operational period it will be actual to remove the moisture from the filter 28S, such that this filter can again be made operative. No matter how this is achieved it will be desirable to effect an outlet of the pressurized gas contained or trapped in the connection between the valves 26S and 30S, and such a pressure relief is achievable by opening the valve or switch 30S towards the outlet conduit 32S, whereby the pressurized gas will expand outwardly into the return conduit 38 for recirculation in the system. Thereafter only a minute amount of gas under a small pressure will be contained in the earlier blocked conduit stretch, and even in view of severe environmental demands it will then be permissible to let out this small amount of gas to the atmosphere. The outlet is effected by opening the solenoid valve 50, whereby the S-stretch is connected to the outlet 52 when the valve 28S is switched into connection with the outlet conduit 48.

It would be possible, then, to effect e.g. a changing out of a moistured filter insertion in the filter 28S, but according to the invention it is preferred in lieu thereof to effect a drying of the filter by means of a flow of drying air that is introduced through the said port D upon originally being introduced from an ordinary shop air system at the port E, e.g. at a pressure of 5–6 bars. This air will pass through the check valve 40S and the solenoid valve 30S up through the filter 28S and therefrom to delivery at 52 through the valves 26S and 50, and the associated drying of the filter 28S can thus take place during the entire operational period of the filter 28T. When it becomes time to shift over the control unit 54 will cause a relevant shifting of the various valves such that the gas flow will be readopted through the filter 28S, while the filter 28T will then in return be dried out in the same manner as described already with respect to the filter 28S. With such an alternating operation it is possible to work all the time with with filters 28S and 28T which will never reach any significant degree of moisturing, and which will, therefore, be well suited to steadily effect an excessive demoisturing of the gas flow.

For obvious reasons, however, it has been found essential that the utilized drying air be really "dry", such that it can leave the filters 28S and 28T in a condition in which they are able to demoisture the gas flow to the very low moisture content. Such a very dry air can be brought about by a heating of the supplied flow of air, but such a heating would be connected with noticeable operational costs, and according to the invention it is preferred to make use of another air drier system, which will be much cheaper in use, viz. the system located between the ports E and D. This system operates quite analogously with the alternating system S,T, as it contains two gas dehumidifying filters 60X and 60Y which, in an alternating manner, are brought to dry the through-flowing air and to be dried, themselves, by means of predried air, respectively. As dry air for the dehumidification of a respective one of these filters may be used a partial flow of the air that has been dried by its throughflow through the other filter, viz. such a partial flow that is passing through the limiter valve 66 from the operative filter 60X or 60Y to the opposite filter 60X and then further for delivery to the atmosphere through an exhaust stub 59 on the relevant solenoid valve 58.

Also in the system here considered each operative air drying filter 60 should be moistured only up to a certain limit, as the delivered drying air will not otherwise be sufficiently dry, and in the X/Y-system, therefore, suitably frequent switchovers should be performed for steadily maintain a required high degree of dryness of the air delivered from port D; however, the frequency of these switchovers should of course not be in any kind of synchronism with the above considered switchings between the demoisturing stretches S and T.

If the inlet air is highly humid it may be desirable to use two sub units 44 arranged in series such that the first unit based on a similar principle effects a coarse demoisturing of the air, whereafter the second unit effects a fine dehumidification thereof.

The condensate fed to the receiver tank 20 may contain a small amount of non-condensible gas, whereby a gas cushion may be formed in the upper end of the tank 20. As more refrigerant is filled into the tank the pressure of this cushion will rise, and it will be required to relieve the pressure from time to time, e.g. governed by a pressure gauge P, by letting out gas from the tank, viz. through a solenoid valve 70. Arrangements may be made to cool the associated outlet pipe in order to condensate any fractions of condensible gas hereby leaving the tank to the atmosphere together with the non-condensible gas.

The unit 72 shown in the outlet pipe 6 from the separator 2 is a so-called and well known acid filter, which offers a very low resistance to the flow through the pipe. Element 74 in the suction conduit to the compressor 8 is an expansion valve arranged so as to close for a rising pressure. Element 76 mounted across the compressor is a differential pressure gauge serving to stop the compressor when the supply flow of gas from the container 2 comes to an end, i.e. when no more gas can be drawn from the source to be emptied.

As mentioned, as long as the intake of gas from that source goes on it will be very advantageous that the separator container 2 is not heated, even though it is desired to rapidly convert any transferred liquid gas into its gaseous phase. Practice shows that normally there will be some liquid gas in the inflow to the container 2, but it has been found that the liquid boils up rather quickly in the container even when not heated. In case of refrigerant R-12 the boiling temperature is −29.5° C., and under normal ambient temperature conditions it is a typical result that the temperature in the container 2 will be close to 0° C. as a result of such a boiling. What really matters here is that the vapor pressure in the container and its associated inlet conduit through the valve 4 is kept low, such that it does not form a bar to an extensive withdrawal of refrigerant gas from the source to be emptied. All gas remaining therein will remain uncleaned, and in systems to be scrapped it will remain as a potential source of pollution of the atmosphere.

At the end of the emptying process, when no more gas is obtainable from the system to be emptied, it might be relevant to heat the container 2 in order to drive out any remaining gas potential therefrom to the suction side of the compressor 8.

The oil mist filter 22 is a rather important element, even though the amounts of oil caught therein may be so low as to require attendance only about once a year. The importance is due to the fact that even a very small amount of oil or oil vapor in the gas flow passing the active drying filter 28S or 28T may result in a blocking of the water adsorption ability of the filter material, whereby an even permissible remnant of oil vapor in the gas flow would result in a totally unacceptable reduction of the water adsorption ability of the filter. The reason is that the filter material of a highly effective, so-called molecular filter consists of micro porous filter grains, which will become much less effective if their surface gets covered by even an ultra thin layer of an oily film that would preclude or highly reduce the free access of the water molecules to the water adsorbing filter grains.

According to different official standards the permissible amount of oil in the purified liquid is some 50–100 ppm (or even up to 4000 ppm), but according to the invention the remnant of oil is sought to be reduced to well below 50 ppm in order to secure a perfect operation of the moisture filters, such that the correspondingly required low moisture content of only some 10 ppm can be obtained with the use of reasonably small filters 28S, 28T.

It is highly advantageous that the drying filter equipment is mounted at the discharge side of the compressor, because at this side there is plenty of pressure available for driving the gas through the filter system while maintaining a low vapor pressure on the inlet side of the compressor. Typically the discharge pressure can be some 12–14 bars. The very compression of the gas will be associated with a temperature increase, and it can be taken for sure that at a discharge temperature of some 50–60° C. it will be ascertained that each and every fraction of the refrigerant has been converted into the gaseous phase as required for the following purification of the gas.

The molecules of the gaseous refrigerant will not intrude into the grains of the molecular filter material, unlike the water molecules, and for that reason it will be sufficient to subject the respective filters to a rather brief suction action when they are switched into their self-drying mode of operation. The remnants of refrigerant gas in the filter will be sucked out rather quickly, through port C, such that for avoiding a following blowout of gas laden air in connection with the following blow-through drying of the respective filter 28S or 28T it will be sufficient to subject the filter to the suction action of the compressor 8 for only some five seconds. When thereafter the filter is blown through by drying air let out to the atmosphere there will be practically nothing left of the original gas contents that might pollute the atmosphere.

With the use of the relatively simple air drying system 44 it is possible to reduce the humidity of the inlet air to a certain degree only, and in connection with the invention it has been found that this degree of drying of the air matches perfectly well with the requirements as to the drying of the gas flow for ensuring a permissible low amount of humidity therein. Already this is a most remarkable result of the invention, conditioning the use of a relatively very simple filter system and an economical operation of the drying system.

In the same connection it is important that the air dried in the unit 44 is delivered as drying air to the filter 28 through an expansion valve EV, whereby the air pressure is reduced from shop air pressure, i.e. some 7 bars, to only slightly more than one bar. When the air is delivered in a well dried condition from the unit 44 and is expanded thereafter through the nozzle or valve EV, then the relative humidity will be reduced considerably so that the air becomes still drier and thus adopts a further improved drying capacity.

Another possibility, of course, is to dry the air additionally or exclusively by means of heating.

Under normal operational conditions it will be sufficient to effect switchover between the two filters 28S or 28T the two stretches S and T based on a pure timing, once the functional characteristics of the apparatus have been ascertained. The same is true for the shifting between the stretches X and Y in the unit 44.

Figure 2:
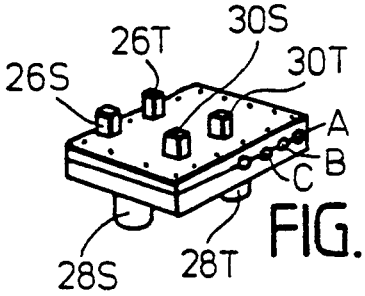
FIG. 2 is a perspective view of a block unit used therein.

The various conduits and components constituting the entire unit 16 may advantageously be arranged in connection with a block structure e.g. corresponding to certain hydraulic stations. This is shown schematically in FIG. 2. All conduits are arranged as block channels, and the solenoid valves are placed on the top side of the block, while the filters are placed depending from the lower side thereof. The oil mist filter 22 and the two filters 28 are heat insulated.

Figure 3:
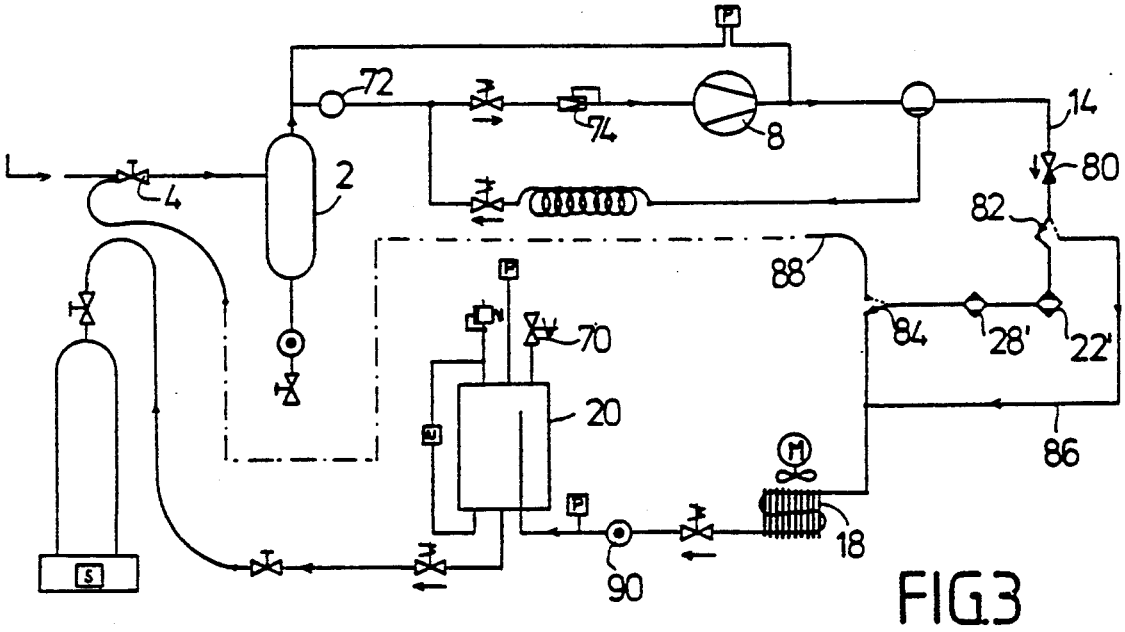
FIG. 3 is a diagram of a simplified embodiment.

In FIG. 3 is shown a modified embodiment, in which the unit 16 of FIG. 1 is replaced by a simplified unit 16', in which the compressed gas passes through a check valve 80, a first switchover valve 82, an oil mist filter 22', a drying filter 28', and a second switchover valve 84, from which the gas is passed to the condenser 18. Also connected thereto is a conduit 86 from the valve 82, through which the gas may be guided to bypass the elements 22', 28' and 84. By means of the switchover valve 84 the gas from the filter 28' may be returned to the inlet in front of the separator container 2 through a conduit 88.

Based on tests and experience it will be desirable to subject the filter 84 to a drying treatment after a certain time of operation since the last drying. Alternatively a moisture indicator 90 between the condenser 18 and the receiver tank 20 will show when drying is required. In this embodiment the filter 28' is not adapted to be air dried, but merely to be changed with respect to its moisture adsorbing filter material. However, it is still important to avoid an escape of the gas housed in the filter and its associated conduits to the atmosphere; to this end the valve 84 is switched to the position in which it connects the filter 28' with the conduit 88, which may be a loose hose, and the valve 22' is switched to the position in which it connects the oil separator 10 with the condenser through conduit 86. Thereafter the compressor 8 is started for a rather brief period, e.g. just some 5–20 seconds, as this is sufficient for the compressor to suck out practically all the gas trapped between the two valves 82 and 84. In the meantime a small amount of non-filtered gas will pass to the condenser 18 through the bypass conduit 6, but this amount will be negligible.

Thereafter the filter 28' may be opened and the filter insert or material be renewed. Also the important oil mist filter 22' may be renewed, e.g. for every third time of renewal of the material in the filter 28'.

It should be mentioned that the elements 22 and 22' are advantageously constituted by 'Bar 7' coalescing filter elements, code 100-25-BX, marketed by Balston Ltd., England.

I claim:

1. An apparatus for reclaiming and recovering volatile liquids, comprising an inlet separator container in connection with the suction side of a compressor for intake of liquid in a gaseous phase thereof and a condenser in connection with the discharge side of the compressor, said condenser being further connected with receiver means for condensed liquid, and purifying filter means arranged in the flow connection between said separator container and said receiver means, the filter means including a moisture adsorbing filter characterized in that the filter means are arranged in the flow connection between the discharge side of the compressor and the condenser and that an oil mist filter is mounted upstream of the moisture adsorbing filter.

2. An apparatus according to claim 1, in which the filter means with associated inlet and outlet mounted in one or more parallel conduits closeable by opposed valve means at both the inlet and the outlet side preparatory to renewal or drying of the filter means, the space between the opposed valve means being connectable with a suction source, preferably the suction side of the compressor, operable to convey gas sucked out from said space to a closed receiver or to reintroduction into the fluid to be processed.

3. An apparatus according to claim 1, in which the moisture adsorbing filter means are arranged as separate units in parallel, whereas switch valve means are operable in an alternating manner to connect one unit in the said flow connection and another unit to a source of dried atmospheric air for flow-through drying of the other unit.

4. An apparatus according to claim 3, in which an air drying station is arranged in operative connection with the filter system, adapted for receiving compressed shop air, drying the air, preferably by means of a dual alternating drying filter system, and delivering the air at considerably reduced pressure for low resistance flow through the filter unit to be dried.

5. An apparatus according to claim 4, in which the conduits of the filter system and the air drying station are provided in a common block member carrying the various filter and valve components.

* * * * *